US009719281B2

(12) United States Patent
Tsai

(10) Patent No.: US 9,719,281 B2
(45) Date of Patent: Aug. 1, 2017

(54) REINFORCING METHOD AND ARRANGEMENT FOR FOLDABLE FURNITURE

(71) Applicant: Frank Tsai, Shenzhen (CN)

(72) Inventor: Frank Tsai, Shenzhen (CN)

( * ) Notice: Subject to any disclaimer, the term of this patent is extended or adjusted under 35 U.S.C. 154(b) by 182 days.

(21) Appl. No.: 14/490,673

(22) Filed: Sep. 19, 2014

(65) Prior Publication Data

US 2015/0001897 A1 Jan. 1, 2015

Related U.S. Application Data

(62) Division of application No. 13/135,029, filed on Jun. 22, 2011, now Pat. No. 8,870,278.

(51) Int. Cl.

| | |
|---|---|
| ***E05D 11/06*** | (2006.01) |
| ***A47C 4/48*** | (2006.01) |
| ***E05D 3/02*** | (2006.01) |
| ***A47C 4/00*** | (2006.01) |
| ***A47B 3/02*** | (2006.01) |
| ***A47C 4/20*** | (2006.01) |
| ***A47C 4/24*** | (2006.01) |
| ***A47C 4/04*** | (2006.01) |

(52) U.S. Cl.

CPC ..... *E05D 11/06* (2013.01); *A47B 3/02* (2013.01); *A47C 4/00* (2013.01); *A47C 4/04* (2013.01); *A47C 4/20* (2013.01); *A47C 4/24* (2013.01); *A47C 4/48* (2013.01); *E05D 3/02* (2013.01); *Y10T 29/4962* (2015.01); *Y10T 29/49826* (2015.01); *Y10T 403/16* (2015.01); *Y10T 403/32254* (2015.01); *Y10T 403/32606* (2015.01)

(58) Field of Classification Search

CPC .... A47C 5/10; A47C 4/14; A47C 4/20; A47C 4/24; A47C 7/002; A47C 3/045; A47C 4/10; A47C 4/38; A47C 4/48; A47C 3/00; A47C 3/08; A47C 4/34

USPC ..... 297/19, 24, 25, 26, 55, 58; 108/115, 118

See application file for complete search history.

(56) References Cited

U.S. PATENT DOCUMENTS

| | | | | |
|---|---|---|---|---|
| 3,756,166 | A * | 9/1973 | Piretti | 108/6 |
| 4,441,757 | A * | 4/1984 | Gasca Burges | 297/55 |
| 5,524,966 | A * | 6/1996 | Piretti | 297/301.3 |
| 8,322,787 | B2 * | 12/2012 | Smith | 297/239 |

* cited by examiner

*Primary Examiner* — Sarah McPartlin

(74) *Attorney, Agent, or Firm* — Raymond Y. Chan; David and Raymond Patent Firm

(57) ABSTRACT

A reinforcing arrangement for reinforcing a joint portion between two support units of a foldable furniture object, comprising a first mounting unit which comprises a first mounting body and a first guiding member outwardly protruded from the first mounting body mounting on the first support unit; a second mounting unit which comprises a second mounting body and a second guiding member or a second guiding groove complimentary to and moveably engaging with the first mounting unit to define a maximum extending angle of movement, thereby the first and second support unit are guided to lock into position at an unfolded position at the maximum extending angle and to unlock at a folded position; and a connecting unit pivotally connecting the first support unit and the second support unit between which the two mounting units are positioned, thereby the joint portion is reinforced.

13 Claims, 8 Drawing Sheets

REINFORCING METHOD AND ARRANGEMENT FOR FOLDABLE FURNITURE

CROSS REFERENCE OF RELATED APPLICATION

This is a Divisional application that claims the benefit of priority under 35 U.S.C. §119 to a non-provisional application, application Ser. No. 13/135,029, filed Jun. 22, 2011.

BACKGROUND OF THE PRESENT INVENTION

Field of Invention

The present invention relates to foldable furniture such as foldable chair and foldable table, and more particularly to a reinforcing method and arrangement for foldable furniture arranged for connecting at least one tube-like leg support unit with another leg support unit or another frame support unit in a secure, controllable and foldable manner while folding movement of the tube-like leg support unit is guidable and controllable and the connecting junction are reinforced.

Description of Related Arts

Conventional foldable furniture, such as foldable chair and foldable table, usually includes a furniture top unit and a frame body to support the top unit in which four leg support units are provided and mounted in a foldable manner. Light duty foldable furniture usually has two pairs of leg support units and a plurality of rivets for mounting the leg support units. For example, each of the leg support units has a mounting through-hole provided approximately in the middle portion of the leg support unit such that two of the leg support units can be mounted in the middle portion with a rivet penetrating the two mounting through-holes of the two leg support units, which is then deformed to secure the two leg support units into position. The manufacture method is simple and the cost is low. However, this kind of support has several drawbacks. First, the support is not strong and cannot be used for medium to heavy duty foldable chair or table, and may be insufficient for light duty foldable chair or table. Second, the mounting position of the leg support is limited to the middle or upper portion of the leg support in order to provide a stable and balance frame structure. Third, the rotational angle between two leg support units is not controllable and additional frame elements are required to restrict the rotational movement of the leg support units. Fourth, the rivet is subject to the weight of the foldable furniture and to the weight of the object on the foldable furniture, making the rivet a breakable part of the frame structure. Fifth, the mounting position of the leg support units is subject to direct and immediate force for supporting the foldable furniture, making the leg support units easy to deform or distort in position and hence weakening the frame structure. Accordingly, this kind of mounting is fragile, making the foldable furniture easy to collapse.

Another common mounting arrangement includes mounting a pair of leg support units onto two sides of a furniture top unit such as a chair seat or a table top with rivets in a foldable manner, which is insufficient and uncontrollable.

Another common mounting arrangement includes a mounting bar or plate rotatably mounted between two leg units. Usually, a first pair of leg support units are mounted to the frame structure and a second pair of leg support units are mounted to the first pair of leg support units through a mounting bar in a foldable manner. Accordingly, the second pair of leg support units are relatively detached from the frame structure for supporting purpose and additional support frame structure such as supporting bar or side bar has to be included. The leg support units themselves cannot be used to provide sufficient support to the furniture while specific and dedicate frame construction is required to provide support for the furniture. In other words, this kind of mounting method for foldable furniture is not only weak but also complicate and costly.

SUMMARY OF THE PRESENT INVENTION

The invention is advantageous in that it provides a reinforcing method and arrangement for foldable furniture which is secure, cost-effective and universal to any cross-bar support structure, capable of reinforcing the connecting junction of at least one leg support unit while enhancing the overall support to the foldable furniture.

Another advantage of the invention is to provide a foldable furniture object which comprises a top unit; a foldable frame assembly which includes a frame support unit and a leg support unit; and a reinforcing arrangement connecting the leg support unit to the frame support unit in a foldable and secure manner while reinforcing the junction between the frame support unit and the leg support unit.

Another advantage of the invention is to provide a foldable furniture object which comprises a top unit; a foldable frame assembly which includes a frame support unit and a leg support unit; and a reinforcing arrangement connecting the leg support unit to the frame support unit in such a manner that the junction between the frame support unit and the leg support unit is reinforced and a maximum unfolding angle of the leg support unit relative to the frame support unit is defined.

Another advantage of the invention is to provide a foldable furniture object which comprises a top unit; a foldable frame assembly which includes a frame support unit and a leg support unit; and a reinforcing arrangement connecting two leg members of the leg support unit in a foldable and secure manner while reinforcing the junction between the two leg members.

Another advantage of the invention is to provide a foldable furniture object which comprises a top unit; a foldable frame assembly which includes a frame support unit and a leg support unit; and a reinforcing arrangement connecting two leg members of the leg support unit in such a manner that the movement of the two leg members are guided and the joint portion of the two leg members are reinforced.

Another advantage of the invention is to provide a reinforcing arrangement for reinforcing a joint portion between two support units of a foldable furniture object which comprises two mounting units complimentary to and engaging with each other to guide the movement of the two support units while reinforcing the joint portion.

Additional advantages and features of the invention will become apparent from the description which follows, and may be realized by means of the instrumentalities and combinations particular point out in the appended claims.

According to the present invention, the foregoing and other objects and advantages are attained by a reinforcing arrangement for reinforcing a joint portion between two support units of a foldable furniture object, wherein the reinforcing arrangement comprises a first mounting unit which comprises:

a first mounting body and a first guiding member outwardly protruded from the first mounting body mounting on the first support unit; and a second mounting unit which comprises a second mounting body and a second guiding element (such as a second guiding member or a second guiding groove) complimentary to and moveably engaging with the first mounting unit to define an extending angle of movement of the first and second mounting units with respect to each other, thereby the first and second support units are guided to lock into position at an unfolded position at the extending angle and to unlock at a folded position; and a connecting unit pivotally connecting the first support unit and the second support unit between which the two mounting units are positioned so as to reinforce the joint portion accordingly.

According to another aspect of the present invention, the foregoing and other objects and advantages are attained by a foldable frame assembly for a foldable furniture object which includes a top unit, comprising:

a leg support unit;

a frame support unit supporting the top unit and pivotally connecting to the leg support unit in a foldable manner such that the leg support unit is capable of being folded into a folded position as well as unfolded to an unfolded position;

one or more joint portions at which the frame assembly is pivotally mounted; and a reinforcing arrangement for each joint portion, thereby each the joint portion is reinforced to spread the force applied to the joint portion through the reinforcing arrangement to the leg support unit through the reinforcing arrangement, wherein the reinforcing arrangement comprises:

a first reinforcing unit mounted onto the foldable frame assembly at the joint portion; and a second reinforcing unit complimentary to and pivotally connected with the first reinforcing unit in such a manner that the first reinforcing unit is guided to pivotally move along the second reinforcing unit defining an extending angle of movement between the first reinforcing unit and the second reinforcing unit, thereby the leg support unit is able to be locked into position at the unfolded position through the first and second reinforcing units.

Preferably, each the first reinforcing unit is a first mounting unit mounted onto the leg support unit and each the corresponding second reinforcing unit is a second mounting unit mounted onto the frame unit, wherein each the first mounting unit comprises a first guiding member outwardly protruded from the leg support unit, and each the second mounting unit corresponding to the first mounting unit has a guiding element which can be embodied as a guiding groove complimentary provided for receiving and operatively connected with the first guiding member in such a manner that the first guiding member is capable of being guided to move within the guiding groove, thereby the maximum extending angle of movement between the leg support unit and the frame support unit is defined and the leg support unit is locked into position at the unfolded position through the first and second mounting units.

Alternately, the first and second reinforcing units of each the reinforcing arrangement are identical in structure, wherein each of the first and second reinforcing units is a first mounting unit mounted onto one the pair of leg member at the one corresponding joint portion, wherein each the first mounting unit, having a contour body, comprises a first guiding member outwardly protruded from the leg support unit, wherein the two first mounting units are complimentary provided for each others and operatively connected in such a manner that the two first guiding members are capable of being guided to move with respect to each others, thereby the maximum extending angle of movement between the two leg members is defined and the two leg members are interlocked into position at the unfolded position through two first guiding members of the first and second mounting units respectively.

According to another aspect of the present invention, the foregoing and other objects and advantages are attained by a reinforcing method of for reinforcing a joint portion between two support units of a foldable furniture object which comprises the steps of:

(a) constructing a first reinforcing unit and a second reinforcing unit to integrally provided onto the two support units of the foldable furniture object at the joint portion respectively, wherein the second reinforcing unit is complimentary to and pivotally connected with the first reinforcing unit;

(b) guiding a pivotal movement between the two support units through the first reinforcing unit and the second reinforcing unit respectively;

(c) defining an extending angle of movement between the first reinforcing unit and the second reinforcing unit at which the first reinforcing unit and the second reinforcing unit are interlocked into position; and (d) locking the two support units at an unfolded position through interlocking the first and second reinforcing units at the extending angle such that the joint portion of the two support units is reinforced through the first reinforcing units and the second reinforcing units which spread force applied to the joint portion to the two support units.

Preferably, the reinforcing method further comprises the step of:

(e) unlocking the two support units through unlocking the first and second reinforcing units and defining a folded position at which the two support units are parallel to each other.

Accordingly to one exemplary example, the first and the second reinforcing units are two identical first mounting units, each the first mounting unit has a contour body comprising a first guiding member outwardly protruded therefrom, wherein the two first mounting units are complimentary provided for each others and operatively connected in such a manner that the two first guiding members are capable of being guided to move with respect to each others to reach the maximum extending angle of movement between the first and second reinforcing units at which the two support units are interlocked into position at the unfolded position.

In particular, the reinforcing method further comprises the step of: constructing at least one base portion through which the guiding member is integrally extended therefrom the first mounting unit and at least one maximum portion upwardly and gradually extended from the base portion to define an engaging surface between the base portion and the maximum portion for each the first mounting unit such that each the two first guiding members are capable of being guided to move with respect to each others through the two engaging surfaces of the two first guiding members to reach the maximum extending angle of movement for locking the two support units into position at the unfolded position. Preferably, two base portions and two maximum portions are constructed for each of the first guiding members of the first mounting unit corresponding to the first guiding member.

Preferably, the reinforcing method further comprises the step of:

constructing an extended mounting portion for each the first mounting unit which is peripherally extended from the first mounting body to increasing a mounting area of the first mounting unit for mounting onto the support unit such that the joint portion is further reinforced.

Accordingly to another exemplary example, the first reinforcing unit is a first mounting unit which has a contour body comprising a first guiding member outwardly protruded therefrom, wherein the second reinforcing unit is a second mounting unit which has a second mounting body defining a guiding groove thereon in such a manner that the guiding groove is complimentary to and moveably engaging with the first guiding member such that the first guiding member is guided to pivotally move through the guiding groove of the second mounting unit to reach the maximum extending angle of movement, thereby the two support units are locked into position at the unfolded position.

Preferably, the reinforcing method further comprises the step of:

constructing an extended mounting portion for each the of the first and second mounting units respectively, each the extended mounting portion is peripherally extended to increasing a mounting area for mounting onto the support unit such that the joint portion is further reinforced.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
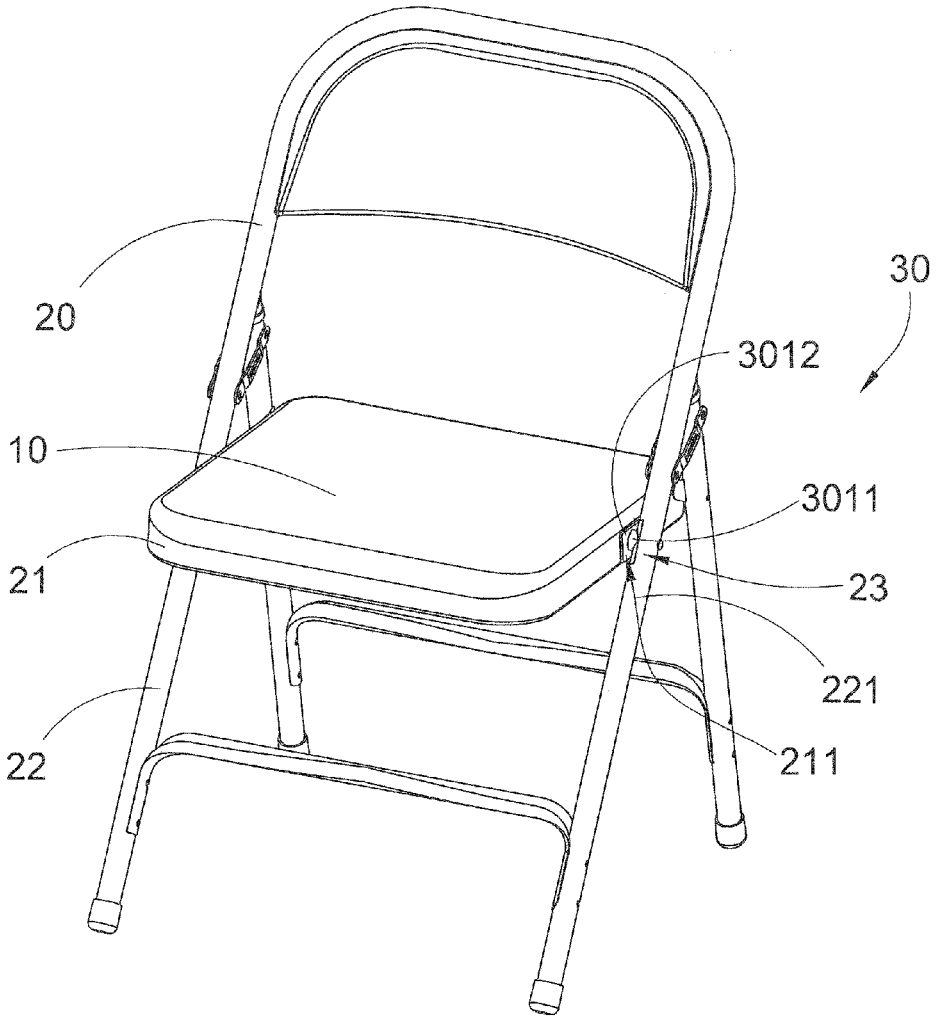
FIG. 1 is a perspective view of a first reinforcing arrangement of a foldable furniture object according to a preferred embodiment of the present invention.

Referring to FIGS. 1 to 6 of the drawings, a foldable furniture object according to the preferred embodiment of the present invention is illustrated. The foldable furniture object includes a top unit 10, a foldable frame assembly 20 and a reinforcing arrangement 30.

The foldable furniture object may be a foldable table or a foldable chair, or the like. Accordingly, the top unit 10 may be a table top, a chair seat or the like which is supported by the foldable frame assembly 20 in a foldable manner and reinforced through the reinforcing arrangement 30. The top unit 10 can be a wooden top unit, a plastic top unit, or a metallic top unit.

The foldable frame assembly 20 comprises a frame support unit 21 connected to the top unit 10, and a leg support unit 22 connected to the frame support unit 21 in a foldable manner such that the leg support unit 22 is capable of being folded to a folded position and unfolded to a unfolded position respectively. In particular, the leg support unit 22 comprises a plurality of leg members 221 supporting the frame support unit 21, wherein the leg members 221 are capable of being folded to the folded position and unfolded into the unfolded position respectively. It is worth mentioning that the foldable frame assembly 20 is capable of providing sufficient rigidity to the foldable furniture in the unfolded position while having a flattened size in the folded position. Preferably, the leg support unit 22 includes four leg members 221 spaced and evenly supporting the frame support unit 21 in the unfolded position. It is worth mentioning that the leg support unit 22 may also include three leg members 221 or six leg members 221 according to the size and structural construction of the foldable furniture for providing sufficient support to the foldable furniture object.

Figure 3:
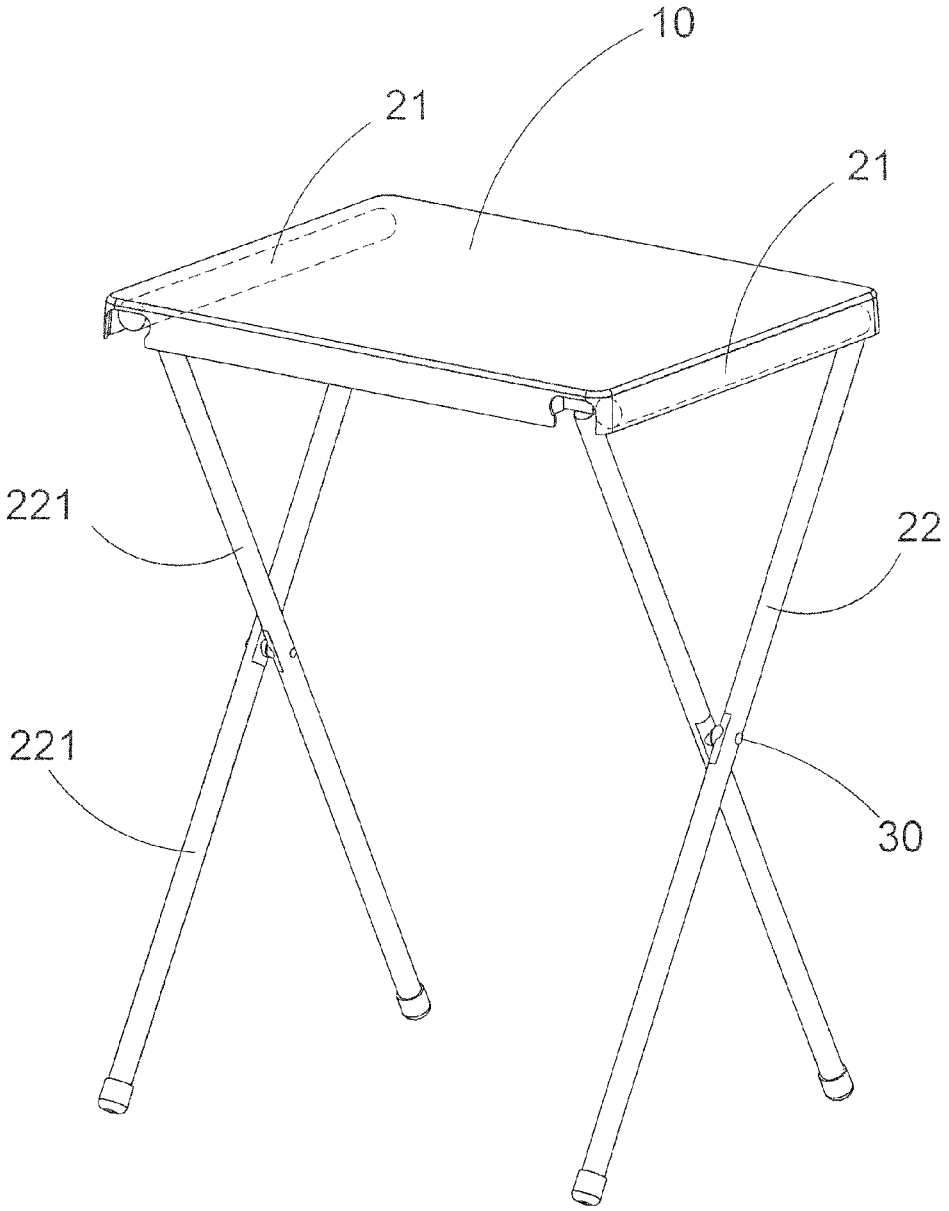
FIG. 3 is a perspective view of a second reinforcing arrangement of a foldable furniture object according to the above preferred embodiment of the present invention.

The foldable frame assembly 20 further defines a plurality of foldable joint portions 23 at which different parts of the foldable frame assembly 20 are connected in a foldable manner. For example, as shown in FIG. 1 of the drawings, one pair of foldable joint portions 23 are defined between the frame support unit 21 and the leg support unit 22 at two sides of the foldable frame assembly 20 respectively. As shown in FIG. 3 of the drawings, one pair of foldable joint portions 23 defined through two pairs of interconnecting leg members 221 at two sides of the foldable frame assembly 20.

The reinforcing arrangement 30 is provided at a plurality of foldable joint portions 23 of the foldable frame assembly 20 such that the joint portions are reinforced. In other words, the reinforcing arrangement 30 is capable of enhancing the foldable joint portions 23 in which the rigidity of the foldable joint portions 23 is increased in the unfolded position while the folding ability of the foldable joint portions 23 is not affected.

The reinforcing arrangement 30 has a specific structural construction to guide the movement of the leg members 221 of the leg support unit 22 in such a manner that the maximum extending angle and direction of movement of the leg support unit 22 is defined through the reinforcing arrangement 30. In other words, the leg members 221 are guided to lock into position through the reinforcing arrangement 30 to the unfolded position and are guided to unlock into position through the reinforcing arrangement 30 to the folded position. In other words, the reinforcing arrangement 30 is not only capable of providing reinforced rigidity to the joint portions 23, but also guiding the leg members to move between the folded position and the unfolded position.

The reinforcing arrangement 30 further provides force balancing effect to the foldable furniture. In particular, the reinforcing arrangement 30 comprises two reinforcing units 301 arranged for mounting onto two different parts of the foldable frame assembly 20 at the foldable joint portion 23 at which the two different parts of the foldable frame assembly 20 are connected in a foldable manner such that when the foldable frame assembly 20 is in the unfolded position, the two reinforcing units 31 is biased against each other and any force acting on the foldable joint portions 23 is spread to the two different parts of the foldable frame assembly 20 through the reinforcing units 31.

Referring to FIG. 1 of the drawings, the foldable furniture object is a foldable chair and the reinforcing arrangement 30 is provided at two foldable joint portions 23 on two sides of the foldable frame assembly 20 respectively at which the frame support unit 21 and the leg support unit 22 are connected. Accordingly, not only the joint portions 23 are reinforced, the angle and direction of movement of the leg support unit 22 are defined, and the force acted on the joint portions 23 is spread to the frame support unit 21 and the leg support unit 22 respectively.

Figure 2:
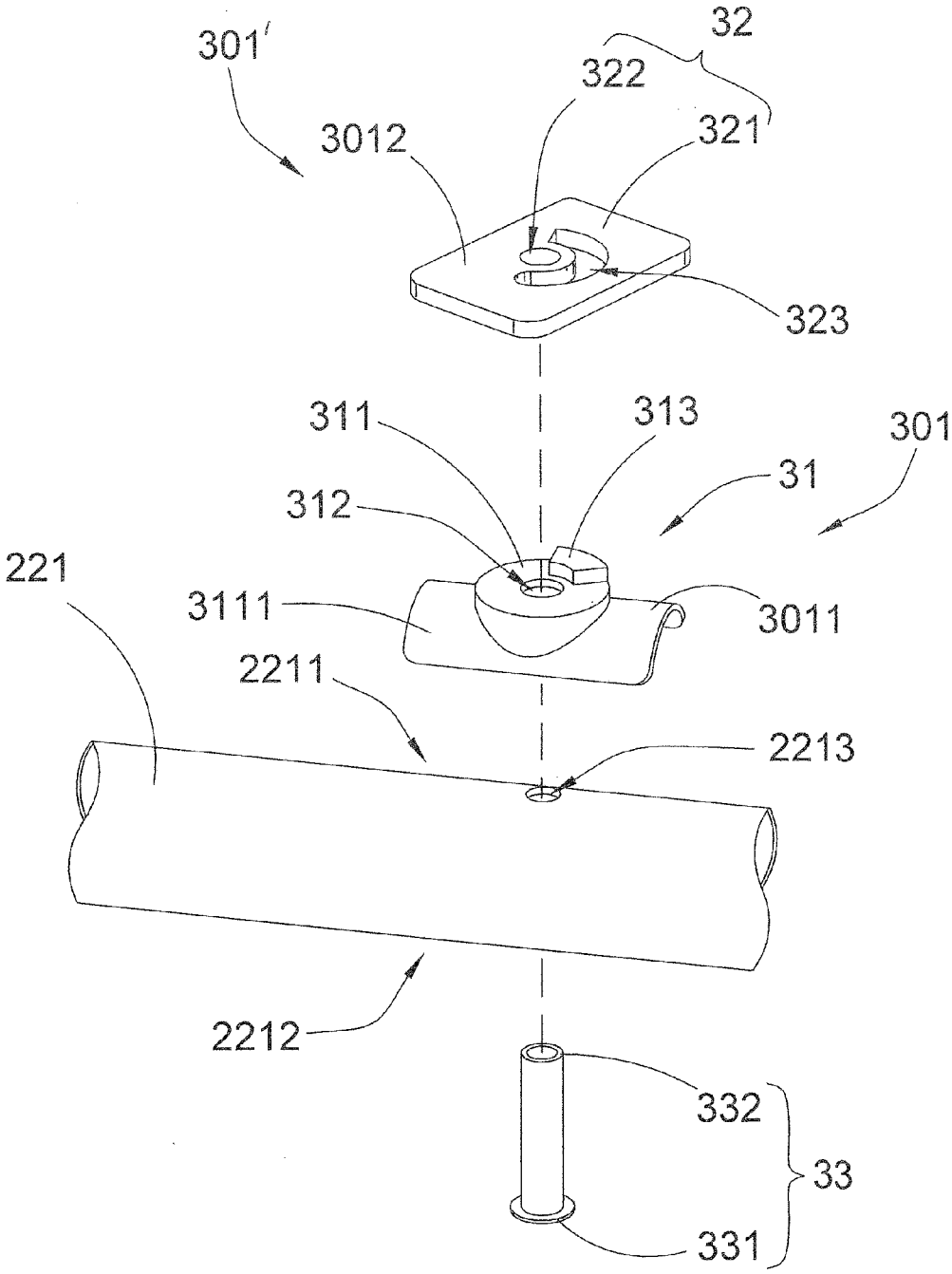
FIG. 2 is an exploded view of a first reinforcing arrangement of a foldable furniture, object according to the above preferred embodiment of the present invention.

Referring to FIG. 2 of the drawings, the two reinforcing units 301, namely the first and second reinforcing units 3011, 3012, are provided on the leg support unit 22 and the frame support unit 21 respectively, and a connecting unit 33 of the reinforcing arrangement is provided to axially and moveably connecting the leg support unit 22 and the frame support unit 21 in such a manner that the two reinforcing units 301 are connected between the leg support unit 22 and the frame support unit 21 for reinforcing the joint portion, guiding the angle and direction of movement of the leg support unit 22 with respect to the frame support unit 21 while spreading the force applied on the joint portion to the frame support unit 21 and the leg support unit 22 respectively.

In particular, the first reinforcing unit 3011 (301) is a first mounting unit 31 comprising a first mounting body 311 defining a first mounting hole 312 and a first guiding member 313 outwardly protruded from the first mounting body 311, wherein the first mounting unit 311 is arranged for mounting onto the leg member 221 having a leg connecting hole 2213 transversely extended through two sides 2211, 2212 of the leg member 221 in such a manner that the first mounting unit 31 is securely mounted onto the leg member 221 at a first side 2211 such that the leg connecting hole 2213 is coaxially aligned with and exposed through the first mounting hole 312 and the first mounting body 311 is integrally extended from the first side 2211 of the leg member 221, while the first guiding member 313 is outwardly extended from the first side 2211.

The second reinforcing unit 3012 (301) is a second mounting unit 32 comprising a second mounting body 321 defining a second mounting hole 322 and a guiding grove 323 complimentary provided for the first guiding member 313, arranged for mounting onto the frame support unit 21 in such a manner that the second mounting unit 32 is securely mounted onto the frame support unit 21 through the second mounting body 321, the second mounting hole 322 is coaxially aligned with and exposing a frame connecting hole 211 of the frame support unit 21, and the first guiding member 313 is moveably received in the guiding groove 323 such that the movement of the guiding member 313 is guided to move within the guiding groove 323 of the second mounting unit 32.

The connecting unit 33 has a shaft body having a head end 331 and a tail end 332 to moveably mounted the leg member 221 and the frame support unit 21 between which the first mounting unit 31 and the second mounting unit 32 is positioned.

Accordingly, the leg member 221 and the frame support unit 21 are connected through the first mounting unit 31, the second mounting unit 32 and the connecting 33 in a folding manner such that the joint portion 23 is reinforced, the angle and direction of movement of the leg support unit 22 with respect to the frame support unit 21 is guided and the force applied on the joint portion is spread to the frame support unit 21 and the leg support unit 22.

Preferably, the first mounting body 311 has an extended mounting portion 3111 peripherally extended from the first mounting body 311 to increasing the mounting area of the first mounting body 311 for mounting onto the leg member 221.

It is worth mentioning that the reinforcing arrangement 30 can also be provided between two leg members 221 of the leg support unit 22. In other words, the reinforcing arrangement 30 is used for reinforcing a joint portion 23 between two support units, such as two leg members 221 of the leg support unit 22 or one leg member 221 and the frame support unit 21, of a foldable furniture object. Accordingly, the reinforcing arrangement 30 includes two reinforcing units 301 (3011, 3012) connecting together. As shown in FIG. 2 of the drawings, the two reinforcing units 3011, 3012 are a first mounting unit 31 and a second mounting unit 32 respectively, which are mounted together through a connecting unit 33.

The first mounting unit 31 is integrally mounted onto the first support unit of the foldable furniture object at the joint portion 23 and comprises a first mounting body 311 and a guiding member 313 outwardly protruded from the first mounting body 311.

The second mounting unit 32 is integrally mounted onto the second support unit of the foldable furniture object at the joint portion 23 and comprises a second mounting body 321 and a guiding groove 323 provided on the second mounting body 321, wherein the guiding groove 323 is complimentary to and moveably engaging with the guiding member 313 such that the guiding member 313 is guided to pivotally move through the guiding groove 323 of the second mounting unit 32 to define a maximum extending angle θ of movement between the first and second mounting units 31, 32, thereby the first support unit and the second support unit are capable of being locked into position at an unfolded position at the maximum extending angle θ through the first and second mounting units 31, 32, and are capable of being unlocked at a folded position at which the first support unit and the second support unit are parallel to each other.

The connecting unit 33 is pivotally mounting the first support unit and the second support unit together in such a manner that the first mounting unit 31 and the second mounting unit 32 are complimentarily engaging with each other between the first support unit and the second support unit, thereby any force applied to the joint portion 23 at the unfolded position is capable of being spread to the first and the second support units through the first and the second mounting units 31, 32 respectively.

As shown in FIG. 2 of the drawings, the second mounting body 32 has a second mounting hole 322 at a center of the second mounting body 321, wherein the guiding groove 323 is coaxially aligned with the second mounting hole 322 defining a curvature in such a manner that the curvature is circumferentially and partially surrounding the center of the second mounting body 321 to define the maximum extending angle θ of movement between the first and second mounting units 31, 32, wherein the first mounting body 31 has a first mounting hole 313 at a center of the first mounting body 311 through which the connecting unit 33 connects the first and second mounting units 31, 32.

Preferably, the connecting unit 33 is a rivet which connects the first mounting body 311 and the second mounting body 321 through the first and second mounting holes 312, 322 at the center of the first mounting body 311 and the second mounting body 321 respectively.

Referring to FIGS. 3 to 5C of the drawings, the reinforcing arrangement 30 is provided on the leg support unit 22 at the joint portion 23. The two reinforcing units A301, A301' are provided on two leg members 221 at the joint portion 23, and the connecting unit A33 of the reinforcing arrangement 30 is provided to axially and moveably connecting the two leg members 221 in such a manner that the two reinforcing units A301, A301' are connected between the two leg members 221 for reinforcing the joint portion 23, guiding the angle and direction of movement of the leg members 221 with respect to each other while spreading the force applied on the joint portion 23 to the two leg members 221 of the leg support unit 22.

In particular, two identical reinforcing units A301, A301', which are two first mounting units A31 are provided. In other words, the first and the second reinforcing units A3011, A3012 are identical in structure. The first mounting unit A31 comprises a first mounting body A311 defining a first mounting hole A312 and a first guiding member A313 outwardly protruded from the first mounting body A311, wherein the first mounting unit A311 is arranged for mounting onto the leg member 221 having a leg connecting hole 2213 transversely extended through two sides 2211, 2212 of the leg member 221 in such a manner that the first mounting unit A31 is securely mounted onto the leg member 221 at a first side 2211 such that the leg connecting hole 2213 is coaxially aligned with and exposed through the first mounting hole A312 and the first mounting unit A311 is integrally extended from the first side 2211 of the leg member 221, while the first guiding member A313 is outwardly extended from the first side 2211.

The connecting unit A33 has a shaft body having a head end A331 and a tail end A332 to moveably mounting the two leg members 221 between which the two first mounting units A31 are positioned.

Accordingly, the two leg members 221 are connected through the two first mounting units A31 and the connecting unit A33 in a folding manner such that the joint portion 23 is reinforced, the angle and direction of movement of the leg support unit 22 with respect to the frame support unit 21 is guided and the force applied on the joint portion 23 is spread to the frame support unit 21 and the leg support unit 22.

Preferably, the first mounting body A311 has an extended mounting portion A3111 peripherally extended from the first mounting body A311 to increasing the mounting area of the first mounting body A311 for mounting onto the leg member 221.

Figure 4:
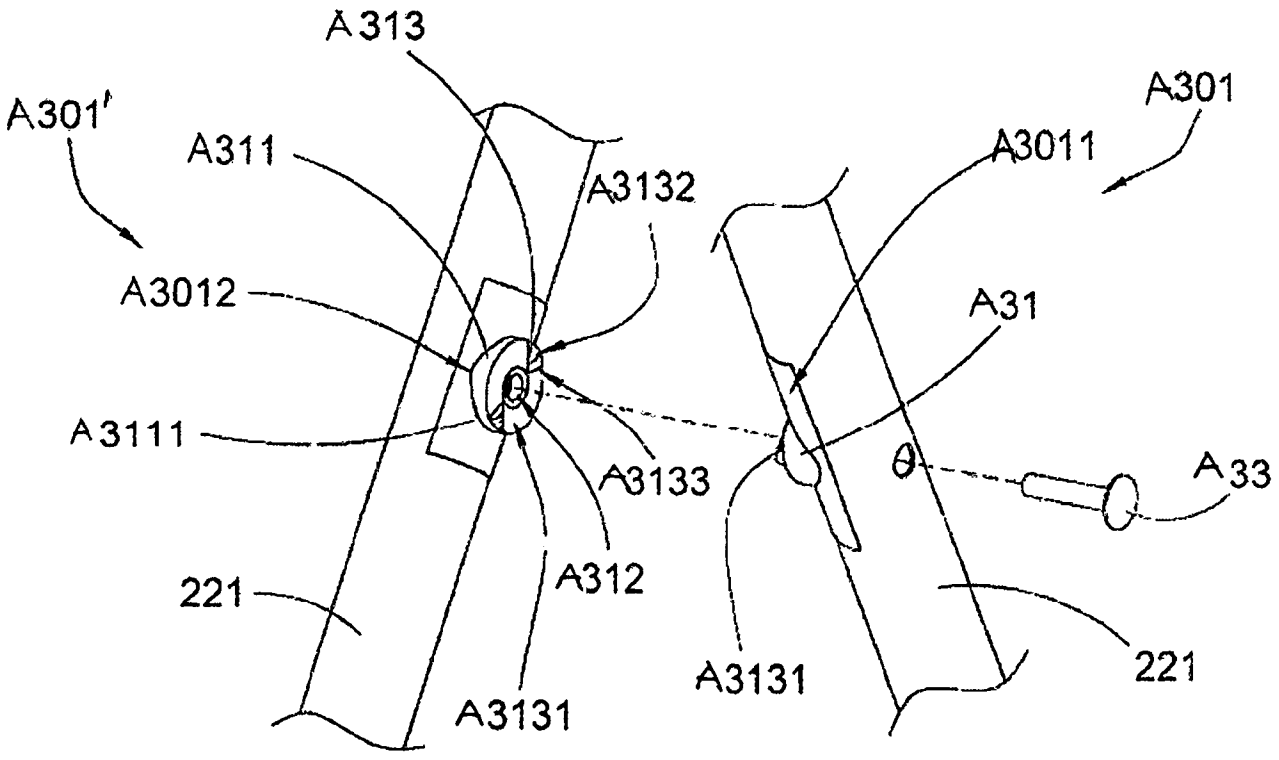
FIG. 4 is a partial exploded view illustration of a second reinforcing arrangement of a foldable furniture object according to the above preferred embodiment of the present invention.
Figure 5B:
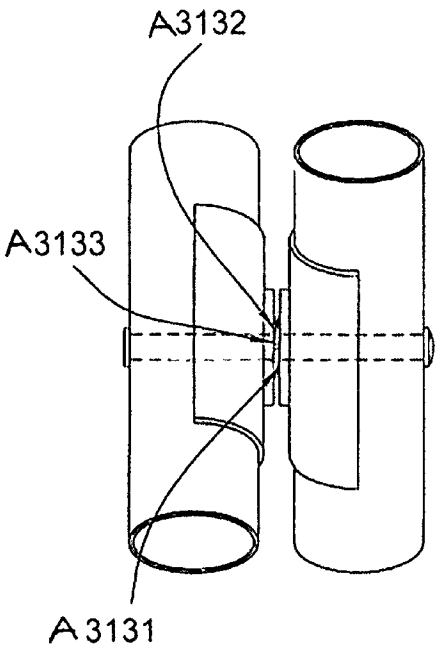
FIG. 5A to 5C are operational illustrations of a second reinforcing arrangement of a foldable furniture object under different conditions according to the above preferred embodiment of the present invention.
Figure 5A:
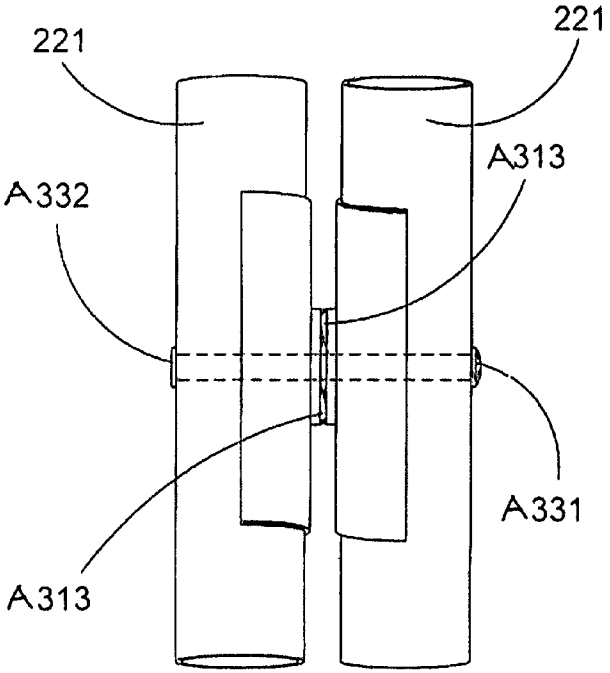
Figure 5C:
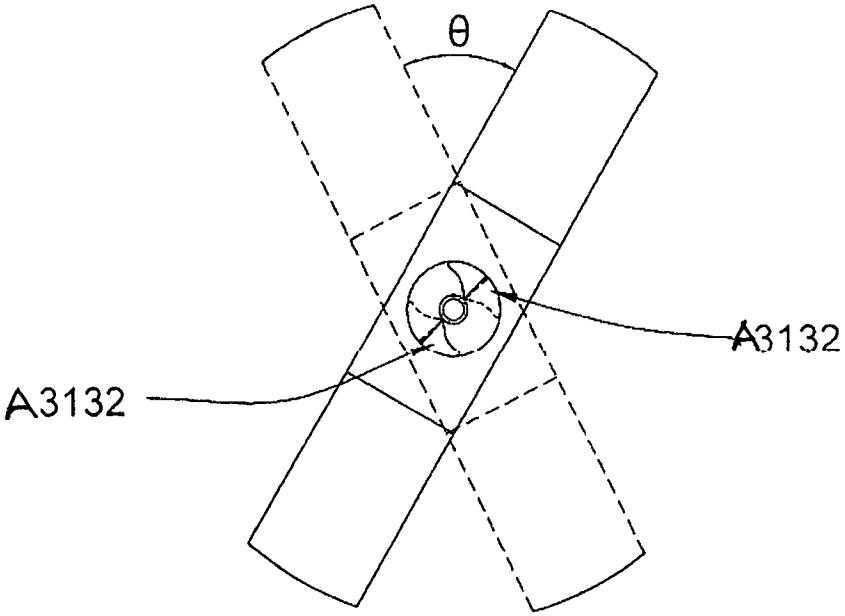

Referring to FIGS. 4 to 5C of the drawings, the guiding member A313 has a contoured body having a base portion A131 and at least one maximum portion A3133 defining a maximum height of the guiding member A313, wherein the base portion A3131 is integrally connected to the first mounting body A311 and the maximum portion A3133 is upwardly and gradually extended from the base portion A3131 to define an engaging surface 3132 between the base portion 3131 and the maximum portion 3133 of the guiding member A313. Accordingly, when two guiding members A313 are provided on two leg members 221 respectively at the joint portion 23, the two mounting units A31 are retained in position through the two corresponding engaging surfaces A3132 of the two guiding members A313 respectively.

Preferably, as shown in FIGS. 4 to 5C of the drawings, each of the guiding members A313 of the leg members 221 has two maximum portions A3133 spacedly extended from the base portion A3131 in such a manner that when the two guiding members A313 are rotatably moved with respect to each other, the movement of the two mounting units A31 are guided through the contoured body of the guiding members A313. In other words, the two leg members 221 is capable of being guided to move to the folded position at which the two leg members 221 are parallel to each other, which is shown in FIG. 5A, and to move to retain at the unfolded position at which the two leg members 221 are retained in position with each other through the engaging surfaces A3132 of the two corresponding guiding members A 313 respectively at the corresponding joint portion 23 and defining the maximum extending angle θ°, which is shown in FIGS. 5B and 5C.

It is worth mentioning that the contoured body of the guiding member A313 has provided the engaging surface A3132 such that the two guiding members A313 at a particular joint portion 23 are retained in position through the two corresponding engaging surfaces A3132 such that any force applied onto the particular joint portion 23 is capable of being diverted away from the joint portion 23 to the two leg members 221 and the connecting unit A33 is reinforced through the provision of guiding members 313.

It is worth mentioning that the reinforcing arrangement 30 as illustrated in FIGS. 4 and 5 of the drawings can also be provided between one leg members 221 of the leg support unit 22 and the frame support unit 21.

Figure 6:
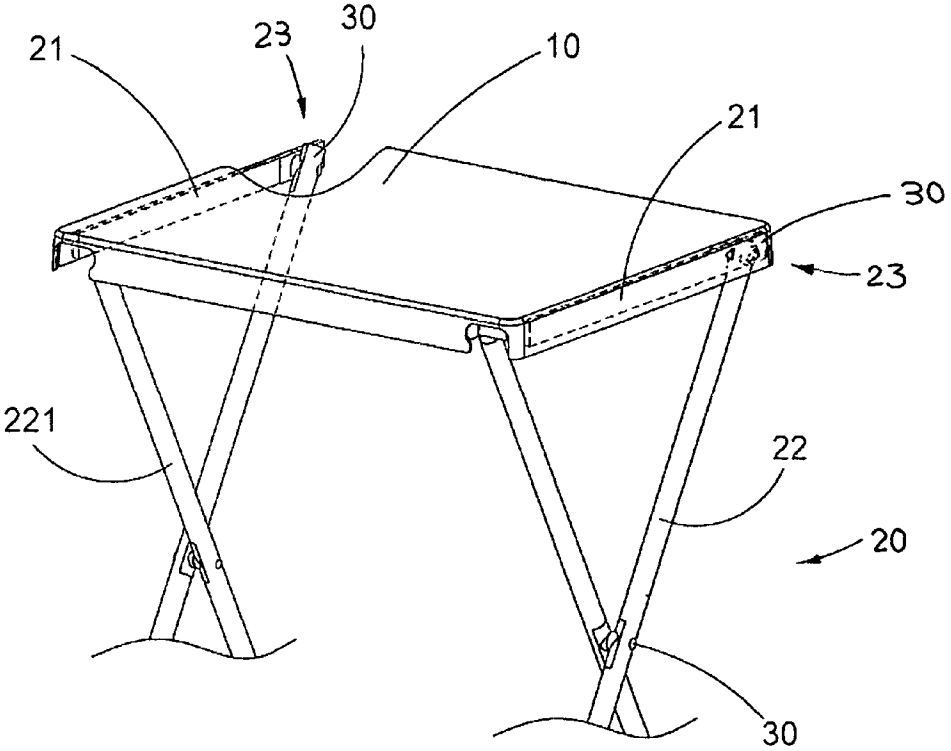
FIG. 6 is an illustration of a first and a second reinforcing arrangement applied in one furniture object according to the above preferred embodiment of the present invention.
Figure 7:
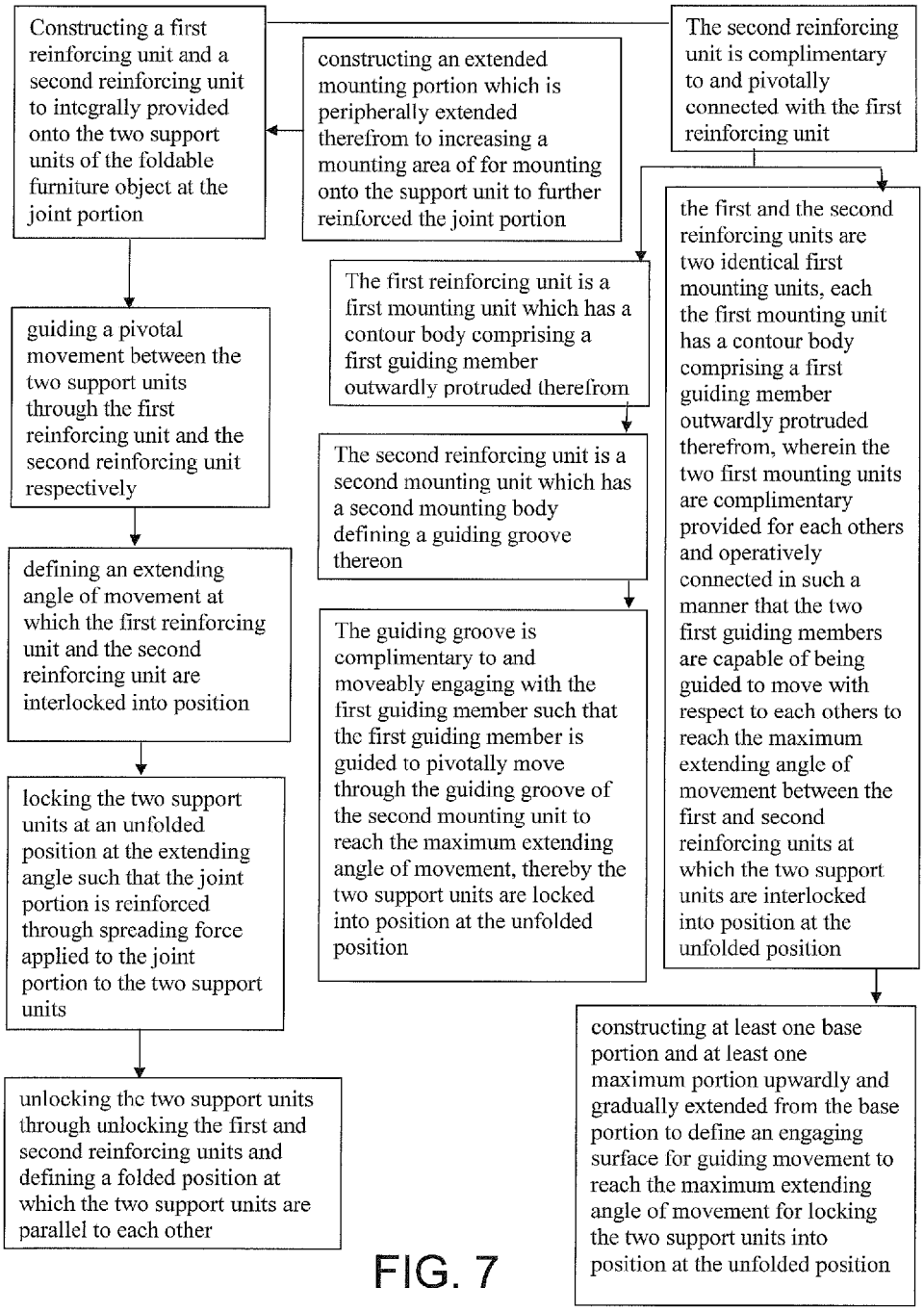
FIG. 7 is an illustration of a reinforcing method and arrangement for foldable furniture according to the above preferred embodiment of the present invention.

Referring to FIG. 6 of the drawings, an exemplary application of the reinforcing arrangement 30 is illustrated in which a first two pairs of reinforcing units A301, A301' are employed between the frame support unit 21 and the leg support unit 22 while a second two pairs of reinforcing units A301, A301' are employed between two pairs of leg members 221 respectively.

Referring to FIGS. 1 to 7 of the drawings, the present invention also provides a reinforcing method of for reinforcing a joint portion 23 between two support units of a foldable furniture object according to the preferred embodiment of the present invention, which comprises the steps of:

(a) constructing a first reinforcing unit A3011 (A301) and a second reinforcing unit A3012 (A301') to integrally provided onto the two support units of the foldable furniture object at the joint portion 23 respectively, wherein the second reinforcing unit A3012 is complimentary to and pivotally connected with the first reinforcing unit A3011;

(b) guiding a pivotal movement between the two support units through the first reinforcing unit and the second reinforcing unit A3011, A3012 respectively;

(c) defining an extending angle of movement between the first reinforcing unit 3011 and the second reinforcing unit A3012 at which the first reinforcing unit A3011 and the second reinforcing unit A3012 are retained in position; and (d) locking the two support units at an unfolded position through retaining the first and second reinforcing units A3011, A3012 at the extending angle such that the joint portion 23 of the two support units is reinforced through the first reinforcing units A3011 and the second reinforcing units A3012 which spread force applied to the joint portion 23 to the two support units.

Preferably, the reinforcing method further comprises the step of:

(e) releasing the two support units through releasing the first and second reinforcing units A3011, A3012 and defining a folded position at which the two support units are parallel to each other.

In other words, the two support units are guided to move between the folded position and the unfolded position through the two reinforcing units A301, A301' (A3011, A3012), while retaining at the unfolded position through the retaining of the first and second reinforcing units A301, A301' (A3011, A3012) at the maximum extending angle to spread force applied to the joint portion 23 to the two support units and to other parts of the furniture object.

The foldable furniture object may be a foldable chair, a foldable table or the like. Therefore, for example, any force applied from the seat onto the two support units, such as two legs 221 of the foldable chair, can be spread to the legs and other parts of the chair. In other words, the joint 23 is protected against from any force being acting directly onto the joint portion. Instead, the two reinforcing units 301, 301' (A301, A301', A3011, A3012) are provided to reinforce the joint portion 23.

Referring to FIGS. 3 to 5C, 6 and 7, the first and the second reinforcing units A301, A301' (A3011, A3012) are two identical first mounting units A31, each the first mounting unit A31 has a contour body A311 comprising a first guiding member A13 outwardly protruded therefrom, wherein the two first mounting units A31 are complimentary provided for each other others and operatively connected in such a manner that the two first guiding members A313 are capable of being guided to move with respect to each other to reach the maximum extending angle of movement between the first and second reinforcing units A301, A301' (A3011, A3012) at which the two support units are retained in position at the unfolded position.

In particular, the reinforcing method further comprises the step of: constructing at least one base portion A3131 through which the guiding member A313 is integrally extended from the first mounting unit A31 and at least one maximum portion A3133 upwardly and gradually extended from the base portion A3131 to define an engaging surface A3132 between the base portion A3131 and the maximum portion A3133 for each first mounting unit A311 such that each of the two first guiding members A313 are capable of being guided to move with respect to each other through the two engaging surfaces A3132 of the two first guiding members A313 to reach the maximum extending angle of movement for retaining the two support units into position at the unfolded position. Preferably, as shown in FIGS. 4 to 5C of the drawings, two base portions A3131 and two maximum portions A3133 are constructed for each of the first guiding members A313 of the first mounting unit A31 corresponding to the first guiding member 313.

Preferably, the reinforcing method further comprises the step of: constructing an extended mounting portion A3111 for each the first mounting unit A31 which is peripherally extended from the first mounting body A311 to increasing a mounting area of the first mounting unit A31 for mounting onto the support unit such that the joint portion 23 is further reinforced.

Alternately, referring to FIGS. 1, 2, 6 and 7 of the drawings, the first reinforcing unit 3011 (301) is a first mounting unit 31 which has a contour body 311 comprising a first guiding member 313 outwardly protruded therefrom, wherein the second reinforcing unit 3012 (301') is a second mounting unit 32 which has a second mounting body 321 defining a guiding groove 323 thereon in such a manner that the guiding groove 323 is complimentary to and moveably engaging with the first guiding member 313 such that the first guiding member 313 is guided to pivotally move through the guiding groove 323 of the second mounting unit 32 to reach the maximum extending angle of movement, thereby the two support units are locked into position at the unfolded position.

Preferably, the reinforcing method further comprises the step of: constructing an extended mounting portion 3111 for each the of the first and second mounting units 31, 32 respectively, each of the extended mounting portion 3111 is peripherally extended to increasing a mounting area for mounting onto the support unit such that the joint portion 23 is further reinforced.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A foldable frame assembly for a foldable furniture object which includes a top unit, comprising:

a leg support unit comprising two pair of leg members;

a frame support unit, for supporting the top unit, pivotally connecting to said leg support unit in a foldable manner such that said leg support unit is capable of being folded into a folded position as well as unfolded to an unfolded position;

a pair of joint portions defined between said frame support unit and said leg support unit, wherein said frame support unit is pivotally connected to said leg support unit, wherein said pair of joint portions are provided at two sides of said foldable frame assembly respectively, wherein each of said joint portions is positioned at each of said two pair of leg members of said leg support unit where a leg member of said pair of leg members is pivotally connected to another leg member of said pair of leg members; and a pair of reinforcing arrangements provided at said pair of joint portions respectively such that said joint portions are reinforced to spread force applied to said joint portions to said leg support unit through said reinforcing arrangements, wherein each of said reinforcing arrangements comprises:

a first reinforcing unit and a second reinforcing unit respectively mounted onto said two leg members of said foldable frame assembly at said joint portion, wherein said first reinforcing unit is pivotally connected with said second reinforcing unit such that said first reinforcing unit is guided to pivotally move with respect to said second reinforcing unit for guiding an angle and direction of movement of said two leg members with respect to each other, thereby said leg support unit is able to be retained in position at the unfolded position through said first and second reinforcing units, wherein said first and second reinforcing units are two identical mounting units mounted onto said two leg members respectively at said joint portion, wherein each of said mounting units has a contour body and comprises a guiding member outwardly protruded from said respective leg member of said leg support unit, wherein said mounting units are operatively connected in such a manner that said two guiding members of said two mounting units are capable of being guided to move with respect to each other, thereby a maximum extending angle of movement between said two leg members is defined and said two leg members are retained in position at the unfolded position through said two guiding members of said two mounting units respectively.

2. The foldable frame assembly, as recited in claim 1, wherein each of said guiding members has a contoured body having a base portion through which said guiding member is integrally extended therefrom and at least one maximum portion upwardly and gradually extended from said base portion to define one engaging surface between said base portion and said maximum portion, such that said two guiding members of said two mounting units at said two leg members are capable of being guided to move with respect to each other through said two engaging surfaces of said two guiding members, thereby the maximum extending angle of movement between said two leg members is defined and said two leg members are retained in position at the unfolded position through said two guiding members of said two mounting units respectively.

3. The foldable frame assembly, as recited in claim 2, wherein each of said guiding members has two maximum portions extended therefrom and spacedly provided thereon, thereby each of said two leg members of one said pair of leg members are capable of being guided to move to the folded position at which said two leg members are parallel to each other and to move to retain at the unfolded position at which said two leg members are retained with each other through said engaging surfaces of said two guiding members respectively.

4. The foldable frame assembly, as recited in claim 2, wherein each of said mounting units has a mounting body defining a first side integrally mounted onto one of said leg members at one said joint portion and a second side from which said guiding member is integrally extended, wherein said mounting body further comprises an extended mounting portion to increase a mounting area of said mounting unit such that said corresponding joint portion is further reinforced.

5. The foldable frame assembly, as recited in claim 3, wherein each of said mounting units has a mounting body defining a first side integrally mounted onto one of said leg members at one said joint portion and a second side from which said guiding member is integrally extended, wherein said mounting body further comprises an extended mounting portion to increase a mounting area of said mounting unit such that said corresponding joint portion is further reinforced.

6. A foldable frame assembly for a foldable furniture object which includes a top unit, comprising:

a leg support unit comprising two pair of leg members;

a frame support unit, for supporting the top unit, pivotally connecting to said leg support unit in a foldable manner such that said leg support unit is capable of being folded into a folded position as well as unfolded to an unfolded position;

a pair of joint portions defined between said frame support unit and said leg support unit, wherein said frame support unit is pivotally connected to said leg support unit, wherein said pair of joint portions are provided at two sides of said foldable frame assembly respectively, wherein each of said joint portions is positioned at each of said two pair of leg members of said leg support unit where a leg member of said pair of leg members is pivotally connected to another leg member of said pair of leg members;

a pair of reinforcing arrangements provided at said pair of joint portions respectively such that said joint portions are reinforced to spread force applied to said joint portions to said leg support unit through said reinforcing arrangements, wherein each of said reinforcing arrangements comprises a first reinforcing unit and a second reinforcing unit respectively mounted onto said two leg members of said foldable frame assembly at said joint portion, wherein said first reinforcing unit is pivotally connected with said second reinforcing unit such that said first reinforcing unit is guided to pivotally move with respect to said second reinforcing unit for guiding an angle and direction of movement of said two leg members with respect to each other, thereby said leg support unit is able to be retained in position at the unfolded position through said first and second reinforcing units; and an additional pair of joint portions provided on two sides of said foldable frame assembly at which said leg support unit and said frame support unit are pivotally connected therewith, wherein each said first reinforcing unit of said reinforcing arrangement provided on said additional pair of joint portions is an additional first mounting unit of each of said joint portions at which each said pair of leg members of said leg support unit are pivotally connected together, wherein each said second reinforcing unit of said reinforcing arrangement provided on said additional pair of joint portions is an additional second mounting unit complimentary provided for operatively connected with said corresponding additional first mounting unit in such a manner that said additional first mounting unit is capable of being guided to move with respect to said additional second mounting unit, thereby the maximum extending angle of movement between said leg support unit and said frame support unit is defined and said leg support unit is retained in position with said frame support unit at the unfolded position through said additional first and second mounting units.

7. The foldable frame assembly, as recited in claim 6, wherein each said first mounting unit of said additional pair of joint portions comprises a first guiding member and each said second mounting unit of said additional pair of joint portions comprises a second mounting body having a guiding groove complimentary and corresponding to said first guiding member such that said first guiding member is capable of being guided to move within said guiding groove, thereby the maximum extending angle of movement between said leg support unit and said frame support unit is defined and said leg support unit is locked into position at the unfolded position through said first and second mounting units.

8. A reinforcing arrangement for reinforcing a joint portion between first and second support units of a foldable furniture object, comprising:

a first mounting unit, adapted to be integrally mounting onto the first support unit of the foldable furniture object at the joint portion, comprising a first mounting body and a first guiding member outwardly protruded from said first mounting body;

a second mounting unit, adapted to be integrally mounted onto the second support unit of the foldable furniture object at the joint portion, comprising a second mounting body and a second guiding member outwardly protruded from said second mounting body, said first and second guiding members moveably engaging with each other such that each of said first and second guiding members is guided to pivotally move with respect to each other to define a maximum extending angle of movement between said first and second mounting units, thereby the first support unit and the second support unit are capable of being retained in position at an unfolded position at the maximum extending angle of movement through said first and second mounting units and are capable of being retained at a folded position at which the first support unit and the second support unit are parallel to each other; and a connecting unit adapted for pivotally mounting the first support unit and the second support unit together in such a manner that said first mounting unit and said second mounting unit are engaging with each other between the first support unit and the second support unit, thereby any force applied to the joint portion at the unfolded position is capable of being spread to the first and the second support units through said first and said second mounting units respectively, wherein said connecting unit is a rivet pivotally connecting said first and second mounting units with said first mounting body and said second mounting body facing each other, wherein said first mounting unit and said second mounting unit are structurally identical, wherein each of said first and second guiding members of said first and second mounting units has a contoured body having a base portion through which said first and second guiding members are integrally extended from said first and second mounting bodies respectively, and that two maximum portions upwardly and gradually extended from said base portion to define an engaging surface between said base portion and each said maximum portion, thereby said first and second guiding members are capable of being guided to move with respect to each other between the folded position and the unfolded position through said engaging surfaces of said first guiding member and said second guiding member respectively, whereby the maximum extending angle of movement between the two support units is defined and the two support units are retained into position at the unfolded position through said two engaging surfaces of said first and second mounting units respectively.

9. A reinforcing method for reinforcing a joint portion between two support units of a foldable furniture object, comprising the steps of:

(a) constructing a first reinforcing unit and a second reinforcing unit to be integrally provided onto the two support units of the foldable furniture object at the joint portion respectively, wherein said second reinforcing unit is pivotally connected with said first reinforcing unit;

(b) guiding a pivotal movement between the two support units by said first reinforcing unit and said second reinforcing unit respectively;

(c) defining an extending angle of movement between said first reinforcing unit and said second reinforcing unit at which said first reinforcing unit and said second reinforcing unit are retained in position; and (d) retaining the two support units at an unfolded position through retaining said first and second reinforcing units at said extending angle of movement between said first and second reinforcing units, such that the joint portion of the two support units is reinforced by said first and second reinforcing units which spread force applied to the joint portion to the two support units, wherein said first and said second reinforcing units are two identical mounting units, each of said mounting units having a contour body and comprising a guiding member outwardly protruded therefrom, wherein said two mounting units are operatively connected in such a manner that said two guiding members of said two mounting units are capable of being guided to move with respect to each other to reach said extending angle of movement between said first and second reinforcing units at which the two support units are retained in position at the unfolded position.

10. The reinforcing method, as recited in claim 9, further comprising a sub-step of:

constructing at least one base portion through which said guiding member is integrally extended from each of said mounting units and at least one maximum portion upwardly and gradually extended from said base portion to define an engaging surface between said base portion and said maximum portion for each of said mounting units, such that said guiding members are capable of being guided to move with respect to each other through said two engaging surfaces of said two guiding members to reach the extending angle of movement for retaining the two support units into position at the unfolded position.

11. The reinforcing method, as recited in claim 10, wherein said two base portions and said two maximum portions are constructed for said guiding members of said mounting unit.

12. The reinforcing method, as recited in claim 11, further comprising a step of constructing an extended mounting portion for each of said mounting units to increase a mounting area of said respective mounting unit for mounting onto the support unit such that the joint portion is further reinforced.

13. The reinforcing method, as recited in claim 12, further comprising a step of:

(e) releasing the two support units by releasing said first and second reinforcing units and defining a folded position at which the two support units are parallel to each other.

* * * * *